US005935903A

United States Patent [19]

Goss et al.

[11] Patent Number: 5,935,903

[45] Date of Patent: Aug. 10, 1999

[54] RECEIVER SHEET FOR THERMAL DYE TRANSFER PRINTING

[75] Inventors: Catherine Jane Goss, Middlesbrough; John Francis, Yarm, both of United Kingdom

[73] Assignee: Imperial Chemical Industries PLC, London, United Kingdom

[21] Appl. No.: 08/849,755

[22] PCT Filed: Dec. 19, 1995

[86] PCT No.: PCT/GB95/02962

§ 371 Date: Aug. 8, 1997

§ 102(e) Date: Aug. 8, 1997

[87] PCT Pub. No.: WO96/19354

PCT Pub. Date: Jun. 27, 1996

[30] Foreign Application Priority Data

Dec. 21, 1994 [GB] United Kingdom ..... 9425874

[51] Int. Cl.[6] ..... B41M 5/035; B41M 5/38

[52] U.S. Cl. ..... 503/227; 427/146; 428/195; 428/304.4; 428/480; 428/910; 428/913; 428/914

[58] Field of Search ..... 8/471; 428/195, 428/304.4, 480, 913, 914, 910; 503/227; 427/146

[56] References Cited

U.S. PATENT DOCUMENTS

| | | | |
|---|---|---|---|
| 5,350,733 | 9/1994 | Campbell et al. | 503/227 |
| 5,468,712 | 11/1995 | Minato et al. | 503/227 |

FOREIGN PATENT DOCUMENTS

| | | |
|---|---|---|
| 0 349 152 | 1/1990 | European Pat. Off. . |
| 0 522 740 | 1/1993 | European Pat. Off. . |
| 0 551 894 | 7/1993 | European Pat. Off. . |

*Primary Examiner*—Bruce H. Hess

[57] ABSTRACT

A thermal transfer printing receiver sheet for use in association with a compatible donor sheet. The receiver sheet has a dye-receptive receiving layer and an opaque biaxially oriented supporting polyester substrate containing (i) small voids, formed around inorganic filler particles, having a mean void size in the range from 0.3 to 3.5 $\mu$m, and (ii) large voids, formed around organic filler particles, having a mean void size in the range from 5 to 21 $\mu$m and less than 15% by number of the voids have a void size greater than 27 $\mu$m.

10 Claims, 2 Drawing Sheets

RECEIVER SHEET FOR THERMAL DYE TRANSFER PRINTING

This invention relates to thermal transfer printing and, in particular, to a thermal transfer printing receiver sheet for use with an associated donor sheet.

Currently available thermal transfer printing (TTP) techniques generally involve the generation of an image on a receiver sheet by thermal transfer of an imaging medium from an associated donor sheet. The donor sheet typically comprises a supporting substrate of paper, synthetic paper or a polymeric film material coated with a transfer layer comprising a sublimable dye incorporated in an ink medium usually comprising a wax and/or a polymeric resin binder. The associated receiver sheet usually comprises a supporting substrate, of a similar material, preferably having on a surface thereof a dye-receptive, polymeric receiving layer. When an assembly, comprising a donor and a receiver sheet positioned with the respective transfer and receiving layers in contact, is selectively heated in a patterned area derived, for example from an information signal, such as a television signal, dye is transferred from the donor sheet to the dye-receptive layer of the receiver sheet to form therein a monochrome image of the specified pattern. By repeating the process with different monochrome dyes, usually cyan, magenta and yellow, a full coloured image is produced on the receiver sheet. Image production, therefore depends on dye diffusion by thermal transfer.

Although the intense, localised heating required to effect development of a sharp image may be applied by various techniques, including laser beam imaging, a convenient and widely employed technique of thermal printing involves a thermal print-head, for example, of the dot matrix variety in which each dot is represented by an independent heating element (electronically controlled, if desired).

Available TTP print equipment has been observed to yield defective imaged receiver sheets comprising inadequately printed spots of relatively low optical density which detract from the appearance and acceptability of the resultant print. There are at least two types of printing flaws. The first type are regularly spaced flaws which are due to gaps appearing between the printed image of adjacent pixels. The regularly spaced flaws are believed to result from inadequate conformation of the donor sheet to the print head at the time of printing. The second type of flaws are smaller and irregularly spaced and are believed to be the result of imperfections in the surface of the receiver sheet. There is a requirement to eliminate both regularly and irregularly spaced printing flaws, without the need of an additional layer, and also to provide a very white receiver sheet to enhance the colours of the printed sheet.

We have now devised a receiver sheet for use in a TTP process which reduces or substantially eliminates at least one or more of the aforementioned problems.

Accordingly, the present invention provides a thermal transfer printing receiver sheet for use in association with a compatible donor sheet, the receiver sheet comprising a dye-receptive receiving layer to receive a dye thermally transferred from the donor sheet, and an opaque biaxially oriented supporting polyester substrate comprising (i) small voids, formed around inorganic filler particles, having a mean void size in the range from 0.3 to 3.5 $\mu$m, and (ii) large voids, formed around organic filler particles, having a mean void size in the range from 5 to 21 $\mu$m and less than 15% by number of the voids have a void size greater than 27 $\mu$m.

The invention also provides a method of producing a thermal transfer printing receiver sheet for use in association with a compatible donor sheet, which comprises forming an opaque biaxially oriented supporting polyester substrate comprising (i) small voids, formed around inorganic filler particles, having a mean void size in the range from 0.3 to 3.5 $\mu$m, and (ii) large voids, formed around organic filler particles, having a mean void size in the range from 5 to 21 $\mu$m and less than 15% by number of the voids have a void size greater than 27 $\mu$m, and applying on at least one surface of the substrate, a dye-receptive receiving layer to receive a dye thermally transferred from the donor sheet.

In the context of the invention the following terms are to be understood as having the meanings hereto assigned:

sheet: includes not only a single, individual sheet, but also a continuous web or ribbon-like structure capable of being sub-divided into a plurality of individual sheets.

compatible: in relation to a donor sheet, indicates that the donor sheet is impregnated with a dyestuff which is capable of migrating, under the influence of heat, into, and forming an image in, the receiving layer of a receiver sheet placed in contact therewith.

opaque: means that the substrate of the receiver sheet is substantially impermeable to visible light.

voided: indicates that the substrate of the receiver sheet preferably comprises a cellular structure containing at least a proportion of discrete, closed cells.

film: is a self-supporting structure capable of independent existence in the absence of a supporting base.

The substrate of a receiver sheet according to the invention may be formed from any synthetic, film-forming, polyester material. Suitable materials include a synthetic linear polyester which may be obtained by condensing one or more dicarboxylic acids or their lower alkyl (up to 6 carbon atoms) diesters, eg terephthalic acid, isophthalic acid, phthalic acid, 2,5-, 2,6- or 2.7-naphthalenedicarboxylic acid, succinic acid, sebacic acid, adipic acid, azelaic acid, 4,4'-diphenyldicarboxylic acid, hexahydro-terephthalic acid or 1,2-bis-p-carboxyphenoxyethane (optionally with a monocarboxylic acid, such as pivalic acid) with one or more glycols, eg ethylene glycol, 1,3-propanediol, 1,4-butanediol, neopentyl glycol and 1,4-cyclohexanedimethanol. A polyethylene terephthalate or polyethylene naphthalate film is preferred. A polyethylene terephthalate film is particularly preferred, especially such a film which has been biaxially oriented by sequential stretching in two mutually perpendicular directions, typically at a temperature in the range from 70 to 125° C., and preferably heat set, typically at a temperature in the range from 150 to 250° C., for example as described in GB-A-838,708.

A film substrate for a receiver sheet according to the invention is biaxially oriented, preferably by drawing in two mutually perpendicular directions in the plane of the film to achieve a satisfactory combination of mechanical and physical properties. Formation of the film may be effected by any process known in the art for producing a biaxially oriented polyester film, for example a tubular or flat film process.

In a tubular process simultaneous biaxial orientation may be effected by extruding a thermoplastics polyester tube which is subsequently quenched, reheated and then expanded by internal gas pressure to induce transverse orientation, and withdrawn at a rate which will induce longitudinal orientation.

In the preferred flat film process a film-forming polyester is extruded through a slot die and rapidly quenched upon a chilled casting drum to ensure that the polyester is quenched to the amorphous state. Orientation is then effected by stretching the quenched extrudate at a temperature above the glass transition temperature of the polymer. Sequential orientation may be effected by stretching a flat, quenched extrudate firstly in one direction, usually the longitudinal direction, ie the forward direction through the film stretching machine, and then in the transverse direction. Forward stretching of the extrudate is conveniently effected over a set of rotating rolls or between two pairs of nip rolls, transverse stretching then being effected in a stenter apparatus. Stretching is effected to an extent determined by the nature of the film-forming polyester, for example a linear polyester is usually stretched so that the dimension of the oriented polyester film is from 2.5 to 4.5, preferably 3.0 to 4.0 times its original dimension in each direction of stretching. The substrate is preferably stretched from 2.8 to 3.4, more preferably 3.0 to 3.2 times in the longitudinal direction, and from 3.0 to 3.6, more preferably 3.2 to 3.4 times in the transverse direction.

A stretched film may be, and preferably is, dimensionally stabilised by heat-setting under dimensional restraint at a temperature above the glass transition temperature of the film-forming polyester but below the melting temperature thereof, to induce crystallisation of the polyester.

In order to produce a film having voids, it is necessary to incorporate voiding agents into the polyester film-forming composition. Voiding occurs during the film stretching process as a result of separation between the polyester and the voiding agent. The size of the voids is dependant upon a complex interaction of factors, such as the chemical composition of the voiding agent and the polyester substrate, the particle size of the voiding agent, the temperature and shear of the extrusion process, the degree and temperature of the film stretching and post-stretching crystallisation processes.

By void size is meant the size of the maximum dimension of the void. The shape of a void preferably approximates to an oval plate. The maximum dimension or length of a void (dimension "a" in FIGS. 9 and 10) is generally in the direction of longitudinal stretching of the film. The width of a void (dimension "b" in FIG. 9) is generally in the direction of transverse stretching of the film. The depth of a void is a measure of the thickness of a void (dimension "c" in FIG. 10), ie when the film is viewed edge on.

The mean void size or mean length of the small voids is preferably in the range from 0.5 to 3.0 μm, more preferably 1.0 to 2.5 μm, particularly 1.3 to 2.0 μm, and especially 1.6 to 2.0 μm. The size distribution of the small voids is also an important parameter in obtaining a substrate exhibiting preferred characteristics. In a preferred embodiment of the invention greater than 50%, more preferably greater than 70%, and particularly greater than 90% and up to 100% of the small voids have a void size or length within the range of the mean void size±0.3 μm, more preferably±0.2 μm, and particularly±0.1 μm.

The mean width of the small voids is preferably in the range from 0.2 to 2.5 μm, more preferably 0.6 to 2.0 μm, particularly 1.0 to 1.8 μm, and especially 1.4 to 1.6 μm.

The mean depth or thickness of the small voids is preferably in the range from 0.1 to 1.5 μm, more preferably 0.4 to 0.8 μm.

The small voids are formed around, ie contain, an inorganic filler voiding agent which has been incorporated into the polyester substrate-forming composition. The inorganic filler preferably has a volume distributed median particle diameter (equivalent spherical diameter corresponding to 50% of the volume of all the particles, read on the cumulative distribution curve relating volume % to the diameter of the particles — often referred to as the "D(v,0.5)" value), as determined by laser diffraction, of from 0.3 to 0.9 μm, more preferably from 0.4 to 0.8 μm, and particularly from 0.5 to 0.7 μm.

The presence of excessively large inorganic filler particles can result in the film exhibiting unsightly 'speckle', ie where the presence of individual resin particles in the film can be discerned with the naked eye. Desirably, therefore, the actual particle size of 99.9% by volume of the inorganic filler particles should not exceed 20 μm, and preferably not exceed 15 μm.

Particle size of the inorganic filler particles may be measured by electron microscope, coulter counter, sedimentation analysis and static or dynamic light scattering. Techniques based on laser light diffraction are preferred. The median particle size may be determined by plotting a cumulative distribution curve representing the percentage of particle volume below chosen particle sizes and measuring the 50th percentile. The volume distributed median particle diameter of the filler particles is suitably measured using a Malvern Instruments Mastersizer MS 15 Particle Sizer after dispersing the filler in ethylene glycol in a high shear (eg Chemcoll) mixer.

The concentration of inorganic filler incorporated into the substrate is preferably in the range from 14 to 19% by weight, more preferably 15 to 18% by weight, and particularly 16 to 17% by weight based upon the total weight of the components present in the substrate.

Particulate fillers suitable for generating a voided substrate include conventional inorganic pigments and fillers, particularly metal or metalloid oxides, such as alumina, silica and titania, and alkaline metal salts, such as the carbonates and sulphates of calcium and barium. The inorganic filler may be homogeneous and consist essentially of a single filler material or compound, such as titanium dioxide or barium sulphate alone. Alternatively, at least a proportion of the filler may be heterogeneous, the primary filler material being associated with an additional modifying component. For example, the primary filler particle may be treated with a surface modifier, such as a pigment, soap, surfactant coupling agent or other modifier to promote or alter the degree to which the filler is compatible with the substrate polymer. Barium sulphate is a particularly preferred inorganic filler. In a preferred embodiment of the invention the substrate contains less than 5% by weight, more preferably less than 3% by weight, particularly less than 1% by weight, and especially 0% by weight based upon the total weight of the components present in the substrate, of an inorganic filler other than barium sulphate, ie preferably barium sulphate is essentially the only inorganic filler present in the substrate.

The mean void size or mean length of the large voids is preferably in the range from 7 to 20 μm, more preferably 9 to 19 μm, particularly 11 to 18 μm, and especially 13 to 17 μm. According to the present invention less than 15%, more preferably less than 10%, particularly less than 5%, and especially less than 3% by number of the large voids have a void size or length greater than 27 μm. In a particularly preferred embodiment of the invention less than 30%, more preferably less than 25%, particularly less than 20%, and especially less than 15% by number of the large voids have a void size or length greater than 21 μm.

The mean width of the large voids is preferably in the range from 5 to 18 μm, more preferably 7 to 17 μm, particularly 9 to 16 μm, and especially 11 to 15 μm.

The mean depth or thickness of the large voids is preferably in the range from 2 to 8 μm, more preferably 3 to 6 μm.

The large voids are formed around, ie contain, an organic filler voiding agent which has been incorporated into the polyester substrate-forming composition. A major proportion of the organic filler particles present in the polyester substrate-forming composition, ie prior to any stretching operation, preferably have a particle size in the range from 1 to 10 μm. The organic filler particles are approximately spherical, prior to film stretching, and by particle size is meant the average diameter of a particle. Preferably greater than 70%, more preferably greater than 80%, and particularly greater than 90% by number of the organic filler particles have a particle size in the range from 1 to 9 μm, more preferably 1 to 7 μm, and particularly 2 to 7 μm. In a particularly preferred embodiment of the invention, suitably less than 20%, preferably less than 15%, more preferably less than 10%, particularly less than 5%, and especially less than 3% by number of the organic filler particles, prior to film stretching, have a particle size of greater than 9 μm. The mean particle size of the organic filler particles is preferably in the range from 2 to 8 μm, and more preferably 3 to 6 μm.

The organic filler voiding agent is suitably an olefine polymer, such as a low or high density homopolymer, particularly polyethylene, polypropylene or poly-4-methylpentene-1, an olefine copolymer, particularly an ethylene-propylene copolymer, or a mixture of two or more thereof. Random, block or graft copolymers may be employed. Polypropylene is a particularly preferred organic filler.

The concentration of organic filler incorporated into the substrate is preferably in the range from 3 to 12% by weight, more preferably 4 to 10% by weight, and particularly 4.5 to 7% by weight, based upon the total weight of the components present in the substrate.

In a preferred embodiment of the invention the ratio by number of small voids to large voids present in the substrate is suitably in the range from 5:1 to 1000:1, preferably 25:1 to 700:1, more preferably 100:1 to 600:1, particularly 150:1 to 400:1, and especially 300:1 to 400:1.

The size of the large voids is dependant, inter alia, on the size of the organic filler particles incorporated into the polyester substrate-forming composition. In order to obtain filler particles of the preferred size, it is generally necessary to additionally incorporate a dispersing agent together with the organic filler into the polyester substrate-forming composition. A suitable dispersing agent, particularly for a polyolefine organic filler is a grafted polyolefine copolymer or preferably a carboxylated polyolefine, particularly a carboxylated polyethylene.

The carboxylated polyolefine is conveniently prepared by the oxidation of an olefine homopolymer (preferably an ethylene homopolymer) to introduce carboxyl groups onto the polyolefine chain. Alternatively the carboxylated polyolefine may be prepared by copolymerising an olefine (preferably ethylene) with an olefinically unsaturated acid or anhydride, such as acrylic acid, maleic acid or maleic anhydride. The carboxylated polyolefine may, if desired, be partially neutralised. Suitable carboxylated polyolefines include those having a Brookfield Viscosity (140° C.) in the range 150–100000 cps (preferably 150–50000 cps) and an Acid Number in the range 5–200 mg KOH/g (preferably 5–50 mg KOH/g), the Acid Number being the number of mg of KOH required to neutralise 1 g of polymer. The amount of dispersing agent is preferably within a range from 0.3 to 5.0%, more preferably 0.5 to 2.0%, and particularly 0.8 to 1.2% by weight, relative to the weight of the organic filler.

The inorganic filler, organic filler and/or dispersing agent may be added to the polyester substrate or polyester substrate-forming material at any point in the film manufacturing process prior to the extrusion of the polyester. For example, the inorganic filler particles may be added during monomer transfer or in the autoclave, although it is preferred to incorporate the particles as a glycol dispersion during the esterification reaction stage of the polyester synthesis. The inorganic filler, organic filler and/or dispersing agent may be dry blended with the polyester in granular or chip form prior to formation of a substrate film therefrom, or added as a dry powder into the polyester melt via a twin-screw extruder, or by masterbatch technology. The organic filler, together with the dispersing agent, is preferably added by masterbatch technology.

In a preferred embodiment of the invention, the substrate comprises an optical brightener. An optical brightener may be included at any stage of the polyester synthesis, or substrate production. It is preferred to add the optical brightener to the glycol during polyester synthesis, or alternatively by subsequent addition to the polyester prior to the formation of the substrate, eg by injection during extrusion. The optical brightener is preferably added in amounts of from 50 to 1000 ppm, more preferably 100 to 500 ppm, and particularly 150 to 250 ppm by weight based upon the total weight of the components present in the substrate. Suitable optical brighteners include those available commercially under the trade names "Uvitex" MES, "Uvitex" OB, "Leucopur" EGM and "Eastobrite" OB-1.

The substrate according to the invention is opaque, preferably exhibiting a Transmission Optical Density (TOD) (Macbeth Densitometer; type TD 902; transmission mode) in the range from 1.1 to 1.45, more preferably 1.15 to 1.4, and particularly 1.2 to 1.35, especially for a 150 μm thick film.

The surface of the substrate preferably exhibits an 85° gloss value, measured as herein described, in the range from 20 to 70%, more preferably 30 to 65%, particularly 40 to 55%, and especially 45 to 50%.

The substrate preferably exhibits a whiteness index, measured as herein described, in the range from 90 to 100, more preferably 95 to 100, and particularly 98 to 100 units.

The substrate preferably exhibits a yellowness index, measured as herein described, in the range from 1 to −3, more preferably 0 to −2, particularly −0.5 to −1.5, and especially −0.8 to −1.2.

The substrate preferably exhibits a root mean square surface roughness (Rq), measured as herein described, in the range from 200 to 1500 nm, more preferably 400 to 1200 nm, and particularly 500 to 1000 nm.

The thickness of the substrate may vary depending on the envisaged application of the receiver sheet but, in general, will not exceed 250 μm, will preferably be in a range from 50 to 190 μm, and more preferably 150 to 175 μm.

When TTP is effected directly onto the surface of a substrate as hereinbefore described, the optical density of the developed image tends to be low and it is therefore necessary to apply an additional receiving layer to the surface of the substrate. The receiving layer desirably exhibits (1) a high receptivity to dye thermally transferred from a donor sheet, (2) resistance to surface deformation from contact with the thermal print-head to ensure the production of an acceptably glossy print, and (3) the ability to retain a stable image.

A receiving layer satisfying the aforementioned criteria comprises a dye-receptive, synthetic thermoplastics polymer. The morphology of the receiving layer may be varied depending on the required characteristics. For example, the receiving polymer may be of an essentially amorphous nature to enhance optical density of the transferred image, essentially crystalline to reduce surface deformation, or partially amorphous/crystalline to provide an appropriate balance of characteristics.

The thickness of the receiving layer may vary over a wide range but generally will not exceed 50 μm. The dry thickness of the receiving layer governs, inter alia, the optical density of the resultant image developed in a particular receiving polymer, and preferably is within a range of from 0.5 to 25 μm. In particular, it has been observed that by careful control of the receiving layer thickness to within a range of from 0.5 to 10 μm, in association with an opaque substrate layer of the kind herein described, a surprising and significant improvement in resistance to surface deformation is achieved, without significantly detracting from the optical density of the transferred image.

A dye-receptive polymer for use in the receiving layer suitably comprises a polyester resin, a polyvinyl chloride resin, or copolymers thereof such as a vinyl chloride/vinyl alcohol copolymer.

A suitable copolyester resin derived from one or more dibasic aromatic carboxylic acids, such as terephthalic acid, isophthalic acid and hexahydroterephthalic acid, and one or more glycols, such as ethylene glycol, diethylene glycol, triethylene glycol and neopentyl glycol. Typical copolyesters which provide satisfactory dye-receptivity and deformation resistance are those of ethylene terephthalate and ethylene isophthalate, particularly in the molar ratios of from 50 to 90 mole % ethylene terephthalate and correspondingly from 10 to 50 mole % ethylene isophthalate. Preferred copolyesters comprise from 65 to 85 mole % ethylene terephthalate and from 15 to 35 mole % ethylene isophthalate. A particularly preferred copolyester comprises approximately 82 mole % ethylene terephthalate and 18 mole % ethylene isophthalate.

Preferred commercially available amorphous polyesters include "Vitel PE200" (Goodyear) and "Vylon" polyester grades 103, 200 and 290 (Toyobo). Mixtures of different polyesters may be present in the receiving layer.

Formation of a receiving layer on the receiver sheet may be effected by conventional techniques, for example by casting the polymer onto a preformed substrate, followed by drying at an elevated temperature. Drying of a receiver sheet comprising a polyester substrate and a copolyester receiving layer is conveniently effected at a temperature within a range of from 175 to 250° C. Conveniently, however, formation of a composite sheet (substrate and receiving layer) is effected by coextrusion, either by simultaneous coextrusion of the respective film-forming layers through independent orifices of a multi-orifice die, and thereafter uniting the still molten layers, or, preferably, by single-channel coextrusion in which molten streams of the respective polymers are first united within a channel leading to a die manifold, and thereafter extruded together from the die orifice under conditions of streamline flow without intermixing thereby to produce a composite sheet.

A coextruded sheet is stretched to effect molecular orientation of the substrate, and preferably heat-set, as hereinbefore described. Generally, the conditions applied for stretching the substrate layer will induce partial crystallisation of the receiving polymer and it is therefore preferred to heat set under dimensional restraint at a temperature selected to develop the desired morphology of the receiving layer. Thus, by effecting heat-setting at a temperature below the crystalline melting temperature of the receiving polymer and permitting or causing the composite to cool, the receiving polymer will remain essentially crystalline. However, by heat-setting at a temperature greater than the crystalline melting temperature of the receiving polymer, the latter will be rendered essentially amorphous. Heat-setting of a receiver sheet comprising a polyester substrate and a copolyester receiving layer is conveniently effected at a temperature within a range of from 175 to 200° C. to yield a substantially crystalline receiving layer, or from 200 to 250° C. to yield an essentially amorphous receiving layer.

In one embodiment of the invention, an adherent layer is present between the substrate and receiving layer. The function of the additional adherent layer is to increase the strength of adhesion of the receiving layer to the substrate. The adherent layer preferably comprises an acrylic resin, by which is meant a resin comprising at least one acrylic and/or methacrylic component.

The acrylic resin component of the adherent layer is preferably thermoset, and preferably comprises at least one monomer derived from an ester of acrylic acid and/or an ester of methacrylic acid, and/or derivatives thereof. In a preferred embodiment of the invention, the acrylic resin comprises from 50 to 100 mole %, more preferably 70 to 100 mole %, particularly 80 to 100 mole %, and especially 85 to 98 mole % of at least one monomer derived from an ester of acrylic acid and/or an ester of methacrylic acid, and/or derivatives thereof. A preferred acrylic resin for use in the present invention preferably comprises an alkyl ester of acrylic and/or methacrylic acid where the alkyl group contains up to ten carbon atoms such as methyl, ethyl, n-propyl, isopropyl, n-butyl, isobutyl, terbutyl, hexyl, 2-ethylhexyl, heptyl, and n-octyl. Polymers derived from an alkyl acrylate, for example ethyl acrylate and/or butyl acrylate, together with an alkyl methacrylate are preferred. Polymers comprising ethyl acrylate and methyl methacrylate are particularly preferred. The acrylate monomer is preferably present in the acrylic resin in a proportion in the range from 30 to 65 mole %, and the methacrylate monomer is preferably present in a proportion in the range from 20 to 60 mole %.

Other monomers which are suitable for use in the preparation of the preferred acrylic resin of the adherent layer, which may be preferably copolymerised as optional additional monomers together with esters of acrylic acid and/or methacrylic acid, and/or derivatives thereof, include acrylonitrile, methacrylonitrile, halo-substituted acrylonitrile, halo-substituted methacrylonitrile, acrylamide, methacrylamide, N-methylol acrylamide, N-ethanol acrylamide, N-propanol acrylamide, N-methacrylamide, N-ethanol methacrylamide, N-methyl acrylamide, N-tertiary butyl acrylamide, hydroxyethyl methacrylate, glycidyl acrylate, glycidyl methacrylate, dimethylamino ethyl methacrylate, itaconic acid, itaconic anhydride and half esters of itaconic acid.

Other optional monomers of the acrylic resin adherent layer polymer include vinyl esters such as vinyl acetate, vinyl chloroacetate and vinyl benzoate, vinyl pyridine, vinyl chloride, vinylidene chloride, maleic acid, maleic anhydride, styrene and derivatives of styrene such as chloro styrene, hydroxy styrene and alkylated styrenes, wherein the alkyl group contains from one to ten carbon atoms.

A preferred acrylic resin, derived from 3 monomers comprises 35 to 60 mole % of ethyl acrylate/30 to 55 mole % of methyl methacrylate/2 to 20 mole % of acrylamide or methacrylamide, and particularly comprising approximate molar proportions 46/46/8 mole % respectively of ethyl acrylate/methyl methacrylate/acrylamide or methacrylamide, the latter polymer being especially effective when thermoset, for example in the presence of about 25 weight % of a methylated melamine formaldehyde resin.

A preferred acrylic resin, derived from 4 monomers comprises a copolymer comprising comonomers (a) 35 to 40 mole % alkyl acrylate, (b) 35 to 40 mole % alkyl methacrylate, (c) 10 to 15 mole % of a monomer containing a free carboxyl group and/or a salt thereof, and (d) 15 to 20 mole % of a sulphonic acid and/or a salt thereof. Ethyl acrylate is a particularly preferred monomer (a), and methyl methacrylate is a particularly preferred monomer (b). Monomer (c) containing a free carboxyl group and/or a salt thereof, ie a carboxyl group other than those involved in any polymerisation reaction by which the copolymer may be formed, suitably comprises a copolymerisable unsaturated carboxylic acid, and is preferably selected from acrylic acid, methacrylic acid, maleic acid, and/or itaconic acid. Acrylic acid and itaconic acid are particularly preferred. The sulphonic acid monomer (d) may also be present as the free acid and/or a salt thereof. Preferred salts include the ammonium, substituted ammonium, or an alkali metal, such as lithium, sodium or potassium, salt. The sulphonate group does not participate in the polymerisation reaction by which the adherent copolymer resin is formed. The sulphonic acid monomer preferably contains an aromatic group, and more preferably is p-styrene sulphonic acid and/or a salt thereof.

The weight average molecular weight of the acrylic resin can vary over a wide range but is preferably within the range 10,000 to 10,000,000, and more preferably within the range 50,000 to 200,000.

The acrylic resin preferably comprises at least 30%, more preferably in the range from 40% to 95%, particularly 60% to 90%, and especially 70% to 85% by weight, relative to the total weight of the dry adherent layer. The acrylic resin is generally water-insoluble. The coating composition including the water-insoluble acrylic resin may nevertheless be applied to the substrate as an aqueous dispersion. A suitable surfactant may be included in the coating composition in order to aid the dispersion of the acrylic resin.

If desired, the adherent layer coating composition may also contain a cross-linking agent which functions to cross-link the layer thereby improving adhesion to the substrate. Additionally, the cross-linking agent should preferably be capable of internal cross-linking in order to provide protection against solvent penetration. Suitable cross-linking agents may comprise epoxy resins, alkyd resins, amine derivatives such as hexamethoxymethyl melamine, and/or condensation products of an amine, eg melamine, diazine, urea, cyclic ethylene urea, cyclic propylene urea, thiourea, cyclic ethylene thiourea, alkyl melamines, aryl melamines, benzo guanamines, guanamines, alkyl guanamines and aryl guanamines, with an aldehyde, eg formaldehyde. A useful condensation product is that of melamine with formaldehyde. The condensation product may optionally be alkoxylated. The cross-linking agent may suitably be used in amounts in the range from 5% to 60%, preferably 10% to 40%, more preferably 15% to 30% by weight, relative to the total weight of the dry adherent layer. A catalyst is also preferably employed to facilitate cross-linking action of the cross-linking agent. Preferred catalysts for cross-linking melamine formaldehyde include para toluene sulphonic acid, maleic acid stabilised by reaction with a base, morpholinium paratoluene sulphonate, and ammonium nitrate.

The adherent layer coating composition may be applied before, during or after the stretching operation in the production of an oriented film. The adherent layer coating composition is preferably applied to the substrate between the two stages (longitudinal and transverse) of a thermoplastics polyester film biaxial stretching operation. Such a sequence of stretching and coating is suitable for the production of an adherent layer coated linear polyester film, particularly a polyethylene terephthalate film substrate, which is preferably firstly stretched in the longitudinal direction over a series of rotating rollers, coated, and then stretched transversely in a stenter oven, preferably followed by heat setting.

The adherent layer coating composition is preferably applied to the substrate by any suitable conventional technique such as dip coating, bead coating, reverse roller coating or slot coating.

The adherent layer is preferably applied to the substrate at a coat weight within the range from 0.05 to 10 $mgdm^{-2}$, and more preferably 0.1 to 2.0 $mgdm^{-2}$. For a substrate coated on both surfaces, each adherent layer preferably has a coat weight within the preferred range.

Prior to deposition of the adherent layer onto the substrate, the exposed surface thereof may, if desired, be subjected to a chemical or physical surface-modifying treatment to improve the bond between that surface and the subsequently applied adherent layer. A preferred treatment, because of its simplicity and effectiveness, is to subject the exposed surface of the substrate to a high voltage electrical stress accompanied by corona discharge.

If desired, a receiver sheet according to the invention may additionally comprise an antistatic layer. Such an antistatic layer is conveniently provided on a surface of the substrate remote from the receiving layer. Although a conventional antistatic agent may be employed, a polymeric antistat is preferred. A particularly suitable polymeric antistat is that described in EP-A-0349152, the disclosure of which is incorporated herein by reference, the antistat comprising (a) a polychlorohydrin ether of an ethoxylated hydroxyamine and (b) a polyglycol diamine, the total alkali metal content of components (a) and (b) not exceeding 0.5% of the combined weight of (a) and (b).

A receiver sheet in accordance with the invention may, if desired, comprise a release medium present either within the receiving layer or, preferably as a discrete layer on at least part of the exposed surface of the receiving layer remote from the substrate.

The release medium, if employed, should be permeable to the dye transferred from the donor sheet, and comprises a release agent, for example of the kind conventionally employed in TTP processes to enhance the release characteristics of a receiver sheet relative to a donor sheet. Suitable release agents include solid waxes, fluorinated polymers, silicone oils (preferably cured) such as epoxy- and/or amino-modified silicone oils, and especially organopolysiloxane resins. A particularly suitable release medium comprises a polyurethane resin comprising a poly dialkylsiloxane as described in EP-A-0349141, the disclosure of which is incorporated herein by reference.

The invention is illustrated by reference to the accompanying drawings in which.

Figure 1:
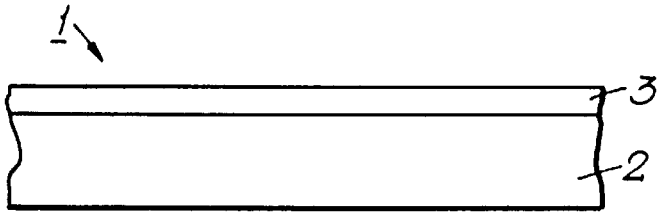
FIG. 1 is a schematic elevation (not to scale) of a portion of a TTP receiver sheet (1) comprising a supporting substrate (2) having, on a first surface thereof, a dye-receptive receiving layer (3).
Figure 2:
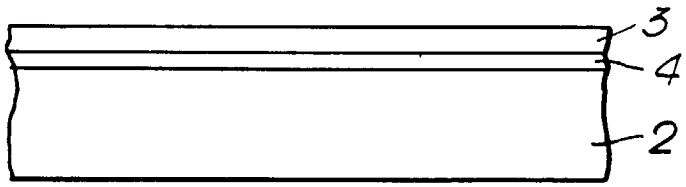
FIG. 2 is a similar, fragmentary schematic elevation in which the receiver sheet comprises an additional adherent layer (4).
Figure 3:
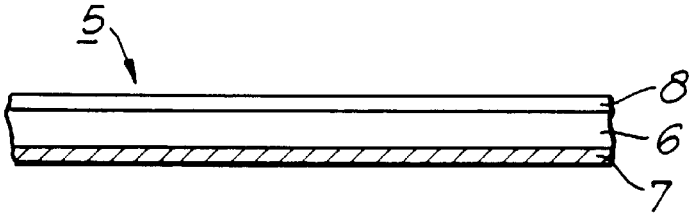
FIG. 3 is a schematic, fragmentary elevation (not to scale) of a compatible TTP donor sheet (5) comprising a substrate (6) having on one surface (the front surface) thereof a transfer layer (7) comprising a sublimable dye in a resin binder, and on a second surface (the rear surface) thereof a polymeric protective layer (8).
Figure 4:
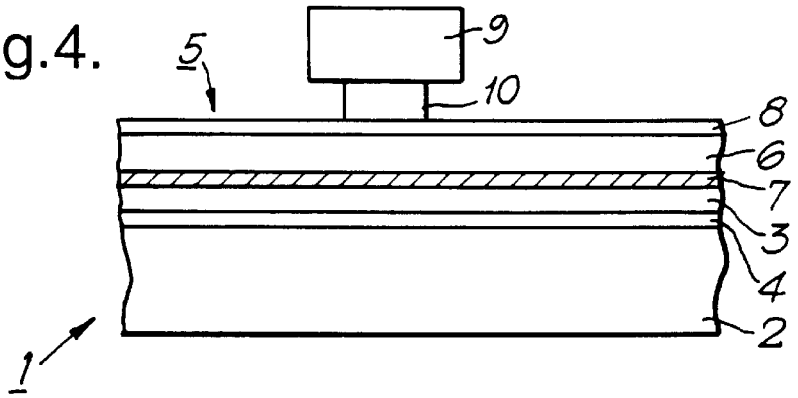
FIG. 4 is a schematic elevation of a TTP process employing the receiver sheet shown in FIG. 2 and the donor sheet shown in FIG. 3.
Figure 5:
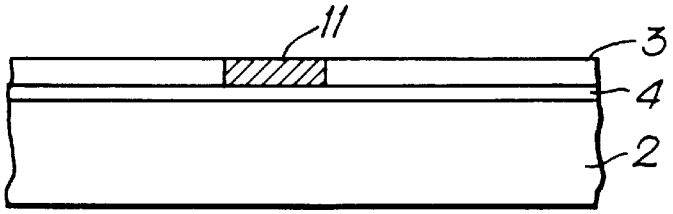
FIG. 5 is a schematic elevation of an imaged receiver sheet.
Figure 6:
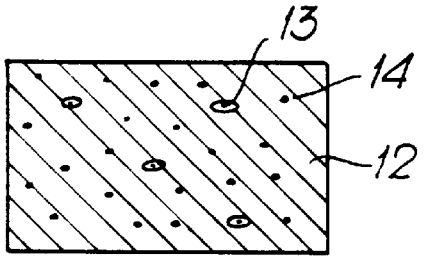
FIG. 6 is a sectional plan view (not to scale) of a portion of an undrawn substrate (precursor substrate of receiver sheet) comprising a polyester matrix (12) having dispersed therein both organic filler particles (13) and inorganic filler particles (14).
Figure 7:
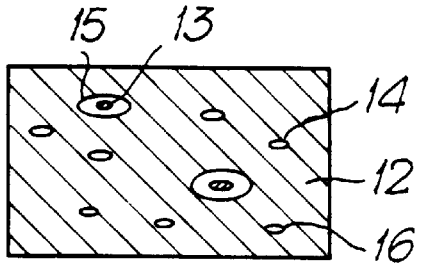
FIG. 7 is a similar sectional plan view of a biaxially oriented substrate of the receiver sheet illustrating the voids (15) and (16) formed around the organic filler particles (13) and inorganic filler particles (14) respectively.
Figure 8:
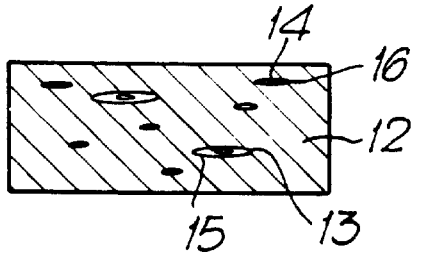
FIG. 8 is a sectional elevation, ie an edge on view, of the oriented substrate shown in FIG. 7, providing an alternative view of the voids (15) and (16) formed around the organic filler particles (13) and inorganic filler particles (14) respectively.
Figure 9:
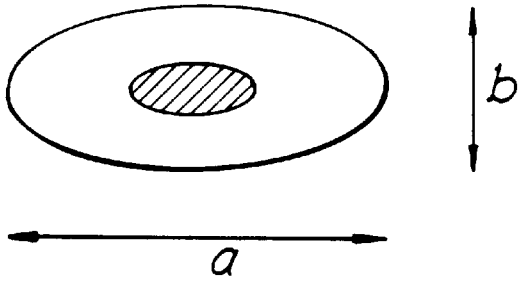
FIG. 9 is a sectional plan view of an individual large void present in the film shown in FIG. 7, illustrating the size or length (dimension "a") and width (dimension "b") of a void.
Figure 10:
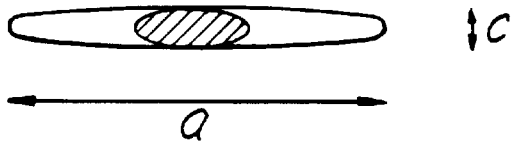
FIG. 10 is a sectional elevation of an individual large void present in the film shown in FIG. 8, illustrating the size or length (dimension "a") and depth or thickness (dimension "c") of a void.

Referring to FIGS. 4 and 5 of the drawings, a TTP process is effected by assembling a donor sheet and a receiver sheet with the respective transfer layer (7) and receiving layer (4) in contact. An electrically-activated thermal print-head (9) comprising a plurality of print elements (only one of which is shown (10)) is then placed in contact with the protective layer of the donor sheet. Energisation of the print-head causes selected individual print-elements (10) to become hot, thereby causing dye from the underlying region of the transfer layer to sublime into receiving layer (4) where it forms an image (11) of the heated element(s). The resultant imaged receiver sheet, separated from the donor sheet, is illustrated in FIG. 5 of the drawings.

By advancing the donor sheet relative to the receiver sheet, and repeating the process, a multi-colour image of the desired form may be generated in the receiving layer.

In this specification the following test methods have been used to determine certain properties of the substrate and receiver sheet:

(i) Transmission Optical Density (TOD)

TOD of the film was measured using a Macbeth Densitometer TD 902 (obtained from Dent and Woods Ltd. Basingstoke, UK) in transmission mode.

(ii) Gloss Value

The 85° gloss value of the film surface was measured using a Dr Lange Reflectometer RB3 (obtained from Dr Bruno Lange, GmbH, Dusseldorf, Germany) based on the principles described in ASTM D 523.

(iii) Whiteness Index and Yellowness Index

The whiteness index and yellowness index of the film was measured using a Colorgard System 2000, Model/45 (manufactured by Pacific Scientific) based on the principles described in ASTM D 313.

(iv) Surface Roughness

The film surface root mean square roughness (Rq) was measured using a Rank Taylor-Hobson Talysurf 10 (Leicester, UK) employing a cut-off length of 0.25 mm.

(v) Void Size

The size of the voids was determined by fracturing, after freezing in nitrogen, a sample of the substrate of the receiver sheet, followed by sputtering with gold. Scanning electron microscope micrographs were prepared, and measurements taken of at least 100, more preferably at least 500, and particularly at least 1000 small voids and large voids. Mean void size or mean length of the small voids and large voids was calculated. In addition, the % of large voids having a void size or length greater than 21 μm, and greater than 27 μm was determined. The measurement of the void size can be performed by eye or by Image Analysis, for example using a Kontron IBAS system.

The invention is further illustrated by reference to the following Examples.

EXAMPLE 1

A substrate layer composition comprising the following ingredients:

| | |
|---|---|
| Polyethylene terephthalate | 74 wt % |
| Polypropylene | 9.6 wt % |
| Carboxylated polyethylene ("AC" wax, supplied by Allied Chemicals) | 0.1 wt % |
| Barium sulphate (volume distributed median particle diameter = 0.6 μm) | 16.3 wt % |

was prepared by first compounding the carboxylated polyethylene into the polypropylene, and using as a masterbatch. The substrate composition was melt extruded, cast onto a cooled rotating drum and stretched in the direction of extrusion to approximately 3.1 times its original dimensions. The film passed into a stenter oven, where the film was stretched in the sideways direction to approximately 3.3 times its original dimensions. The biaxially stretched film was heat set at a temperature of about 220° C. by conventional means. Final film thickness was 175 μm.

The substrate film was subjected to the test procedures described herein and exhibited the following properties.

(i) Transmission Optical Density (TOD)=1.35

(ii) 85° gloss value=31%

(iii) Whiteness Index=99.3 units

Yellowness Index=−1.1 units (iv) Root mean square roughness (Rq)=800 nm (v) Mean void size of the small voids=1.8 μm Mean void size of the large voids=15.3 μm Number of large voids having a void size>21 μm=18%

Number of large voids having a void size>27 μm=3%

A polyester receiving layer was coated directly onto the surface of the substrate.

The printing characteristics of the film were assessed using a donor sheet comprising a biaxially oriented polyethylene terephthalate substrate of about 6 μm thickness having on one surface thereof a transfer layer of about 2 μm thickness comprising a magenta dye in a cellulosic resin binder.

A sandwich comprising a sample of the donor and receiver sheets with the respective transfer and receiving layers in contact was placed on the rubber covered drum of a thermal transfer printing machine and contacted with a print head comprising a linear array of pixels spaced apart at a linear density of 6/mm. On selectively heating the pixels in accordance with a pattern information signal to a temperature of about 350° C. (power supply 0.32 watt/pixel) for a period of 10 milliseconds (ms), magenta dye was transferred from the transfer layer of the donor sheet to form a corresponding image of the heated pixels in the receiving layer of the receiver sheet.

After stripping the transfer sheet from the coated film, the band image on the latter was assessed visually, and no printing flaws (unprinted spots or areas of relatively low optical density) were observed.

EXAMPLE 2

The substrate produced in Example 1 was additionally coated with an adherent layer, prior to applying the polyester receiving layer, ie the receiving layer was applied to the surface of the adherent layer. The adherent layer coating composition was applied to the monoaxially oriented polyethylene terephthalate substrate, ie prior to the sideways stretching. The adherent layer coating composition comprised the following ingredients:

| | |
|---|---|
| Acrylic resin (46% w/w aqueous latex of methyl methacrylate/ethyl acrylate/methacrylamide: 46/46/8 mole %, with 25% by weight methoxylated melamine-formaldehyde) | 163 ml |
| Ammonium nitrate (10% w/w aqueous solution) | 12.5 ml |
| Synperonic NDB (13.7% w/w aqueous solution of a nonyl phenol ethoxylate, supplied by ICI) | 30 ml |
| Demineralised water | to 2.5 liters |

The adherent layer coated film was passed into a stenter oven, where the film was stretched in the sideways direction and heat-set as described in Example 1. The dry coat weight of the adherent layer was approximately 0.4 $mgdm^{-2}$ and the thickness of the adherent layer was approximately 0.04 $\mu$m. The polyester receiving layer described in Example 1 was coated directly on to the surface of the acrylic adherent layer to form the receiver sheet.

The printing characteristics of the receiver sheet were evaluated using the test procedures described in Example 1, and again no printing flaws were observed.

EXAMPLE 3

The procedure of Example 2 was repeated except that substrate layer composition comprised the following ingredients:

| | |
|---|---|
| Polyethylene terephthalate | 78 wt % |
| Polypropylene | 5 wt % |
| Carboxylated polyethylene ("AC" wax, supplied by Allied Chemicals) | 0.05 wt % |
| Barium sulphate (volume distributed median particle diameter = 0.6 $\mu$m) | 17 wt % |

The substrate film was subjected to the test procedures described herein and exhibited the following properties.

(i) Transmission Optical Density (TOD)=1.26
(ii) 85° gloss value=46%
(iii) Whiteness Index=98 units
Yellowness Index=−1 units
(iv) Root mean square roughness (Rq)=600 nm
(v) Mean void size of the small voids=1.75 $\mu$m
Mean void size of the large voids=15 $\mu$m
Number of large voids having a void size>21 $\mu$m=15%
Number of large voids having a void size>27 $\mu$m=2%

The polyester receiving layer described in Example 1 was coated directly onto the surface of the acrylic adherent layer to form the receiver sheet.

The printing characteristics of the receiver sheet were evaluated using the test procedures described in Example 1, and again no printing flaws were observed.

EXAMPLE 4

This is a comparative example not according to the invention. The procedure of Example 2 was repeated except that substrate layer composition comprised 0.05 wt % of carboxylated polyethylene.

The substrate film exhibited the following void characteristics.

(i) Mean void size of the small voids=1.8 $\mu$m
Mean void size of the large voids=16 $\mu$m
Number of large voids having a void size>27 $\mu$m=18%

The polyester receiving layer described in Example 1 was coated directly onto the surface of the acrylic adherent layer to form the receiver sheet.

The printing characteristics of the receiver sheet were evaluated using the test procedures described in Example 1, and printing flaws were observed.

The above examples illustrate the improved properties of a receiver sheet according to the present invention.

We claim:

1. A thermal transfer printing receiver sheet for use in association with a compatible donor sheet, the receiver sheet comprising a dye-receptive receiving layer to receive a dye thermally transferred from the donor sheet, and an opaque biaxially oriented supporting polyester substrate comprising (i) small voids, formed around inorganic filler particles, having a mean void size in the range from 0.3 to 3.5 $\mu$m, and (ii) large voids, formed around organic filler particles, having a mean void size in the range from 5 to 21 $\mu$m and less than 15% by number of the large voids have a void size greater than 27 $\mu$m.

2. A receiver sheet according to claim 1 wherein less than 10% by number of the large voids have a void size greater than 27 $\mu$m.

3. A receiver sheet according to claim 2 wherein less than 5% by number of the large voids have a void size greater than 27 $\mu$m.

4. A receiver sheet according to claim 1 wherein less than 30% by number of the large voids have a void size greater than 21 $\mu$m.

5. A receiver sheet according to claim 4 wherein less than 20% by number of the large voids have a void size greater than 21 $\mu$m.

6. A receiver sheet according to claim 1 wherein the concentration of organic filler particles in the substrate is in the range from 3 to 12% by weight, based upon the total weight of the components present in the substrate.

7. A receiver sheet according to claim 1 wherein the concentration of inorganic filler particles in the substrate is in the range from 14 to 19% by weight, based upon the total weight of the components present in the substrate.

8. A receiver sheet according to claim 1 wherein the ratio by number of small voids to large voids in the substrate is in the range from 25:1 to 700:1.

9. A receiver sheet according to claim 1 wherein the substrate has a root mean square surface roughness (Rq) in the range from 400 to 1200 nm.

10. A method of producing a thermal transfer printing receiver sheet for use in association with a compatible donor sheet, which comprises forming an opaque biaxially oriented supporting polyester substrate comprising (i) small voids, formed around inorganic filler particles, having a mean void size in the range from 0.3 to 3.5 $\mu$m, and (ii) large voids, formed around organic filler particles, having a mean void size in the range from 5 to 21 $\mu$m and less than 15% by number of the large voids have a void size greater than 27 $\mu$m, and applying on at least one surface of the substrate, a dye-receptive receiving layer to receive a dye thermally transferred from the donor sheet.

* * * * *